US006257920B1

(12) United States Patent
Finona et al.

(10) Patent No.: US 6,257,920 B1
(45) Date of Patent: Jul. 10, 2001

(54) CABLE RETENTION CLIP

(75) Inventors: Michael Santos Finona, Fountain Valley; Cecil Galat Crisologo, Yorba Linda, both of CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/344,989

(22) Filed: Jun. 25, 1999

(51) Int. Cl.[7] ..... H01R 13/58
(52) U.S. Cl. ..... 439/455
(58) Field of Search ..... 439/453, 455, 439/610, 454, 404, 406, 606, 736, 877, 882; 285/114

(56) References Cited

U.S. PATENT DOCUMENTS

| | | | | |
|---|---|---|---|---|
| 2,771,588 | | 11/1956 | Schinski et al. | 339/102 |
| 3,093,432 | | 6/1963 | King | 339/59 |
| 3,315,211 | | 4/1967 | Weeks, Jr. | 339/63 |
| 3,395,244 | | 7/1968 | Koehler | 174/135 |
| 4,032,214 | | 6/1977 | McNerney | 339/218 |
| 4,181,394 | | 1/1980 | Dodge | 339/103 |
| 4,274,697 | | 6/1981 | Dodge et al. | 339/103 |
| 4,310,213 | * | 1/1982 | Fetterolf, Sr. et al. | 339/103 M |
| 4,398,785 | | 8/1983 | Hedrick | 339/196 |
| 4,557,545 | | 12/1985 | Ohtsuki et al. | 339/103 |
| 4,582,388 | | 4/1986 | Swaffield | 339/258 |
| 4,702,538 | | 10/1987 | Hutter et al. | 439/292 |
| 4,940,262 | * | 7/1990 | Baracat et al. | 285/114 |
| 4,990,103 | * | 2/1991 | Sazaki et al. | 439/455 |
| 5,051,543 | * | 9/1991 | McGuire | 174/78 |
| 5,100,341 | | 3/1992 | Czyz et al. | 439/447 |
| 5,564,947 | * | 10/1996 | Ingles et al. | 439/589 |
| 5,571,145 | | 11/1996 | Drebin | 607/37 |
| 5,609,499 | | 3/1997 | Tan et al. | 439/445 |

* cited by examiner

*Primary Examiner*—Gary F. Paumen
*Assistant Examiner*—Phuongchi Nguyen
(74) *Attorney, Agent, or Firm*—Roger C. Turner

(57) ABSTRACT

A plug connector has a clip (30) that is crimped to a front portion of a cable jacket to securely lock to the cable jacket and prevent cable pullout while providing strain relief when the cable is jerked up or down, the clip enabling itself to be securely locked to the connector frame. The clip initially has a front portion in the form of a cylindrical sleeve (30A), with slots (51–54) at its opposite sides, the clip being crimped to a shape (30) wherein the opposite sides between the slots are deformed into sidewardly-projecting wings (44, 46). The slots receive the outwardly-bulging crimped cable jacket to better lock the jacket to the clip, and the slots can receive molded polymer material (122, 141) of the frame to lock the frame to the clip. Copper foil wrapped about a first molded part (120) and the clip, provides EMI shielding around cable wires (20) and grounds a connector shell. The clip has a pair of cantilevered beams (60, 62) extending rearwardly from the sleeve part and against the top and bottom of the cable to provide added strain relief. The top and bottom of the clip sleeve portion has a plurality of dimples (90, 92) formed therein during crimping to further lock the clip to the cable jacket.

12 Claims, 3 Drawing Sheets

14
144
12
142
150
141
110
30
110
83
122
84
81
82
94
16
120
140
130
102
20
100
24
10
22
23
M
F
R 12
142
60
62
112
92
90
114
30
32
16
34
24
10

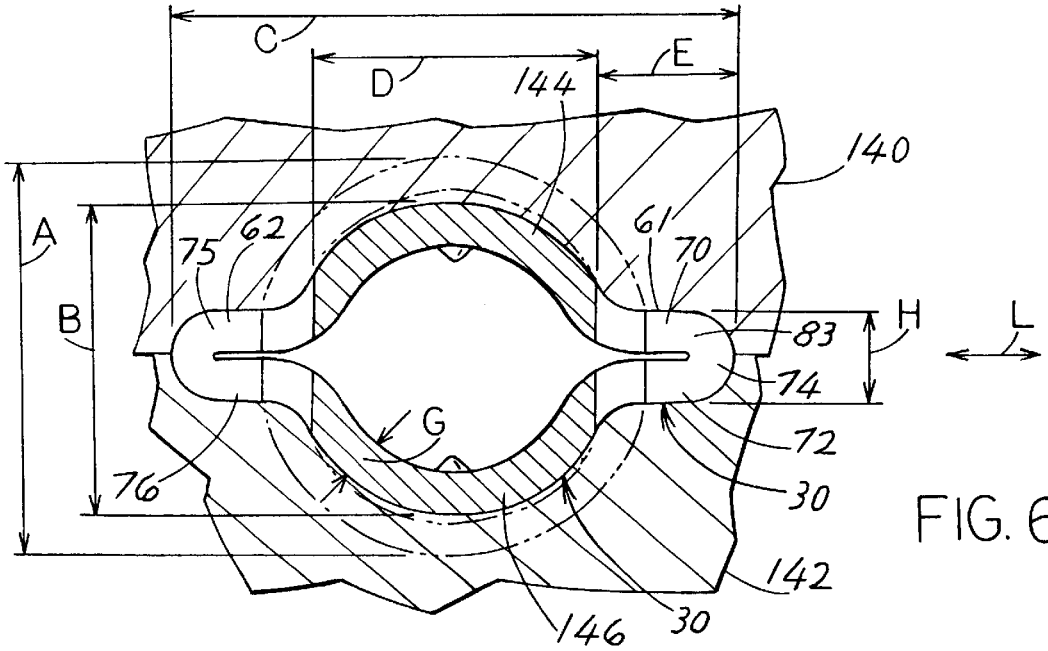
FIG. 6
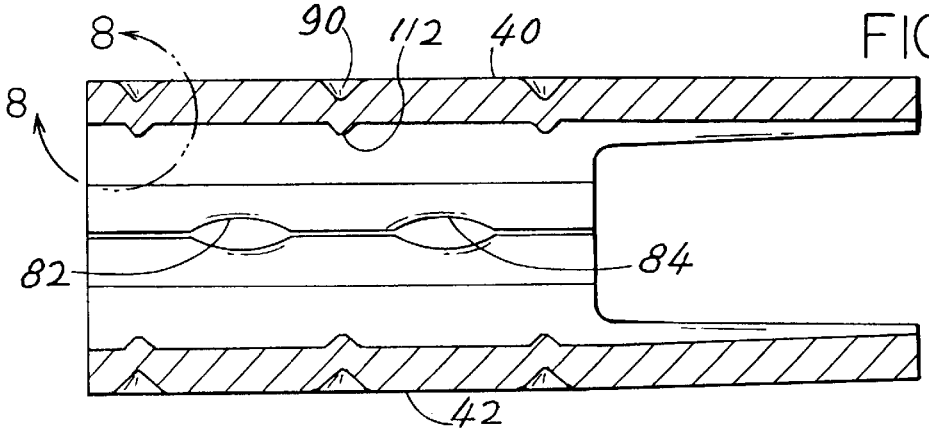
FIG. 7
FIG. 8
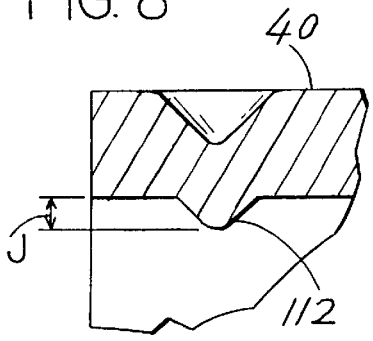
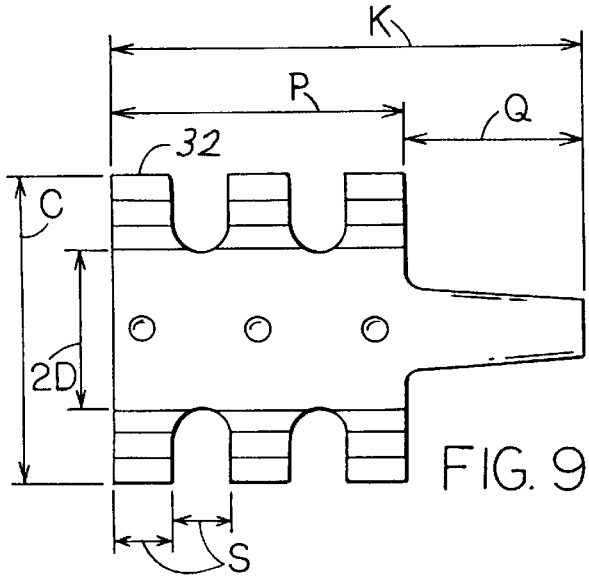
FIG. 9

CABLE RETENTION CLIP

BACKGROUND OF THE INVENTION

The front portion of a cable is terminated to a device such as a connector by stripping away the jacket to expose grounded braiding or foil within the jacket, and to expose wires that can be extended to contacts and be soldered or otherwise connected thereto. A polymer material is molded around the cable and its wires, and around a rearwardly extending length of cable for strain relief. In some applications, the cable is repeatedly pulled and moved up and down and or from side to side. This can result in the cable jacket pulling out of the sheet metal strain relief device and the molded material while breaking off the wires. Metal retainers are often used to prevent pullout and break-off but pullout and break-off still occur. A connector which increased the reliability of holding of the cable against pullout and which increased strain relief to reduce the possibility of cable jacket breakage from fatigue, in a simple manner, would be of value.

SUMMARY OF THE INVENTION

In accordance with one embodiment of the present invention, a clip and a connector including the clip are provided, wherein the clip provides increased holding capacity for a cable jacket to prevent pullout and to provide additional strain relief, with the clip constructed to be securely held by a frame part that is molded around the clip. The clip initially has a major part in the form of a seamless sleeve with slots at opposite sides. A cable whose outside diameter is considerably less than the inside diameter of the sleeve, is inserted through the sleeve. The sleeve is then crimped so its opposite sides are pressed into wings with substantially parallel top and bottom wing parts, and with vertical slots between pairs of wings. The slots, whose lateral depth is a plurality of times greater than the thickness of the sleeve material, receive bulging portions of the crimped cable jacket to help lock the cable into the clip. The deep slots receive molding material that forms the connector frame and that is molded around the clip, to lock the clip into the connector frame.

The clip is preferably crimped by a tool that leaves dimples projecting inward from the top and bottom of the clip, to further lock the cable jacket to the clip. A plurality of cantilevered beams project rearwardly from the rear of the sleeve portion of the clip, to provide additional strain relief for the cable. Material molded around the clip, extends rearwardly around the outside of the cable and around the cantilevered beams of the clip.

In the construction of the connector, the clip is installed and the wires of the cable are terminated to contacts of a connector. Then, a first molded part of polymer is molded around the wires of the cable and into front most slots of the clip. Thereafter, an overmold or second molded part is molded around the first part and into more rearward slots of the clip. Thus, the deep slots of the clip not only lock the clip to the first and second molded parts, but also lock the molded parts to each other.

The novel features of the invention are set forth with particularity in the appended claims. The invention will be best understood from the following description when read in conjunction with the accompanying drawings.

BRIEF DESCRIPTION OF THE DRAWINGS

FIG. 6 is a sectional view of the clip of FIG. 3, taken on line 6—6 thereof, and showing parts of a crimping tool.

FIG. 7 is a sectional view of the clip of FIG. 6.

FIG. 8 is an enlarged view of the portion 8—8 of FIG. 7.

FIG. 9 is a plan view of the clip of FIG. 3.

DESCRIPTION OF THE PREFERRED EMBODIMENTS

Figure 1:
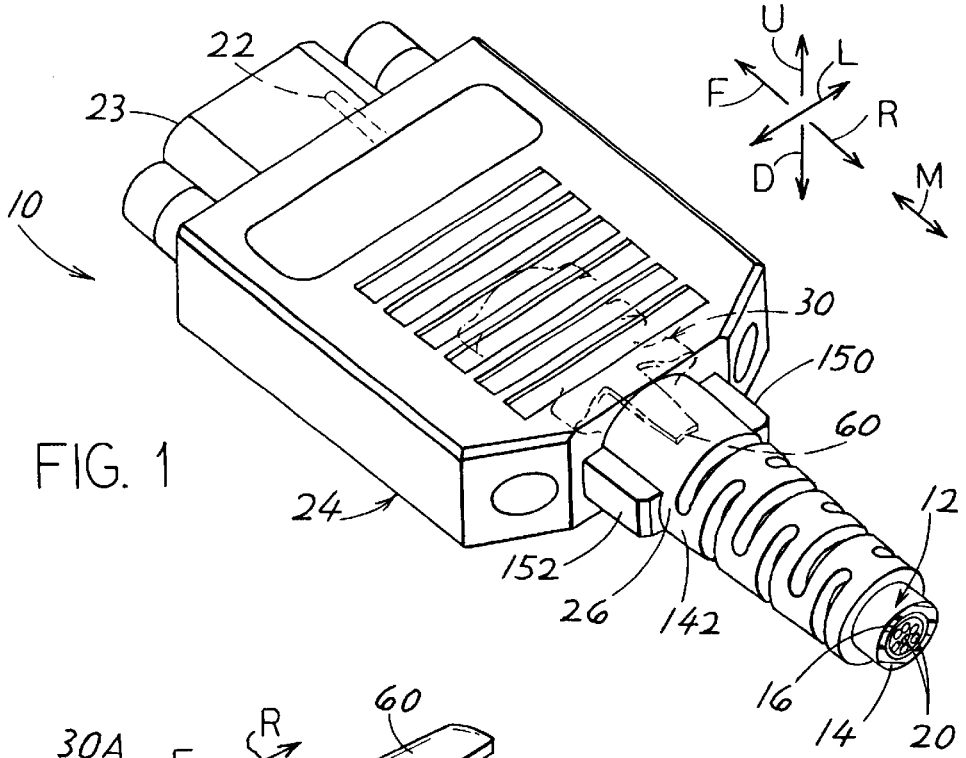
FIG. 1 is a rear isometric view of a plug connector constructed in accordance with the present invention and showing, in phantom lines, a crimped clip within the connector.

FIG. 1 illustrates a connector 10 in the form of a plug, which lies at the front end of a cable 12. The cable includes a thick jacket 14, a ground conductor 16 within the jacket, and a plurality of wires 20 lying within the ground conductor. The wires are connected to contacts 22 at the front end of the connector, the contacts lying within a metal shell 23. The connector has a frame 24 that is largely molded of polymer material, and that has a molded strain relief part 26 at the rear of the frame. In use, the cable 12 may be repeatedly pulled rearwardly R with a large force, and may be repeatedly moved in up and down U, D vertical directions and in lateral directions L while being pulled. The present invention is directed to a construction that minimizes the possibility that the cable will pull out of the frame 24 or that the cable will break To increase secure cable holding, applicant provides a clip shown at 30 in its crimped form, within the frame.

Figure 2:
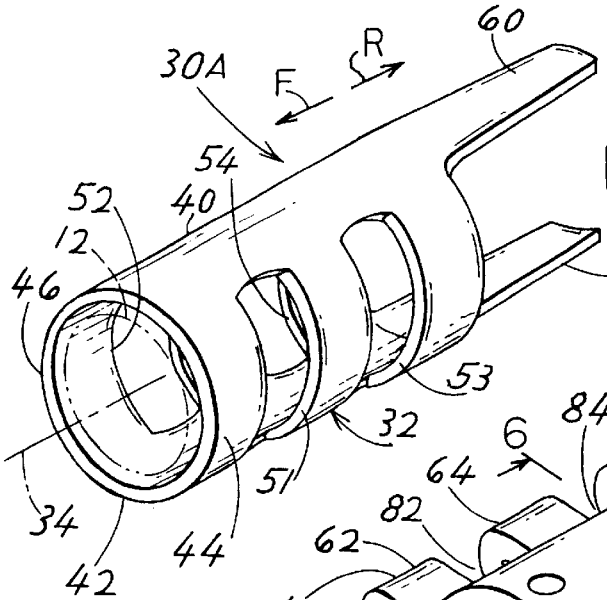
FIG. 2 is a front isometric view of the uncrimped clip which is used in its crimped condition in the connector of FIG. 1.

FIG. 2 shows the clip 30A in its initial or uncrimped condition. The clip includes a sleeve 32 of cylindrical shape, that has an axis 34, a top 40, a bottom 42, and laterally opposite sides 44, 46. The sleeve is formed of malleable metal such as steel, and is seamless. The clip can be formed by cutting off a length of tubing. The sleeve 32 has four slots 51–54, with two slots on each of the opposite sides 44, 46. Each slot extends vertically. A pair of cantilevered beams 60, 62 extend rearwardly from the top and bottom of the sleeve rear end, the beams being cantilevered in that they have free rear ends.

Figure 3:
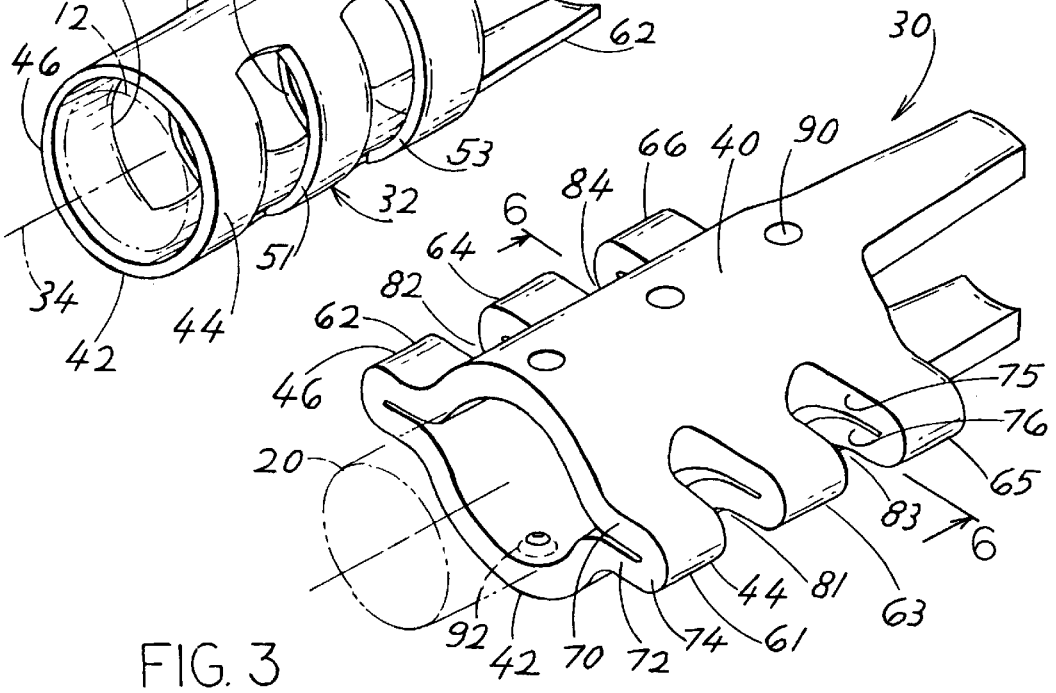
FIG. 3 is an isometric view of the clip of FIG. 2, but in its crimped condition.

FIG. 3 shows the clip 30 in its crimped condition, with the cable shown at 20 in phantom lines. The clip has been crimped by pressing together its top 40 and bottom 42, with the sides 44, 46 being vertically compressed to form horizontally-extending top and bottom beams 70, 72 joined at an end 74 in a substantially 180° loop. The slot portions 75, 76 between pairs of top beams 70 and between pairs of bottom beams 72, are vertically aligned. Because of the presence of the slots 51–54 in the uncrimped clip, deep slots 81–84 are produced in the crimped clip. The side portions outside the slots may be referred to as wings, with the clip having six wings 61–66. In addition, during crimping, applicant forms dimples 90, 92 in the top and bottom of the clip, and corresponding projections at the inside of the clip, which press into the cable jacket.

Figure 4:
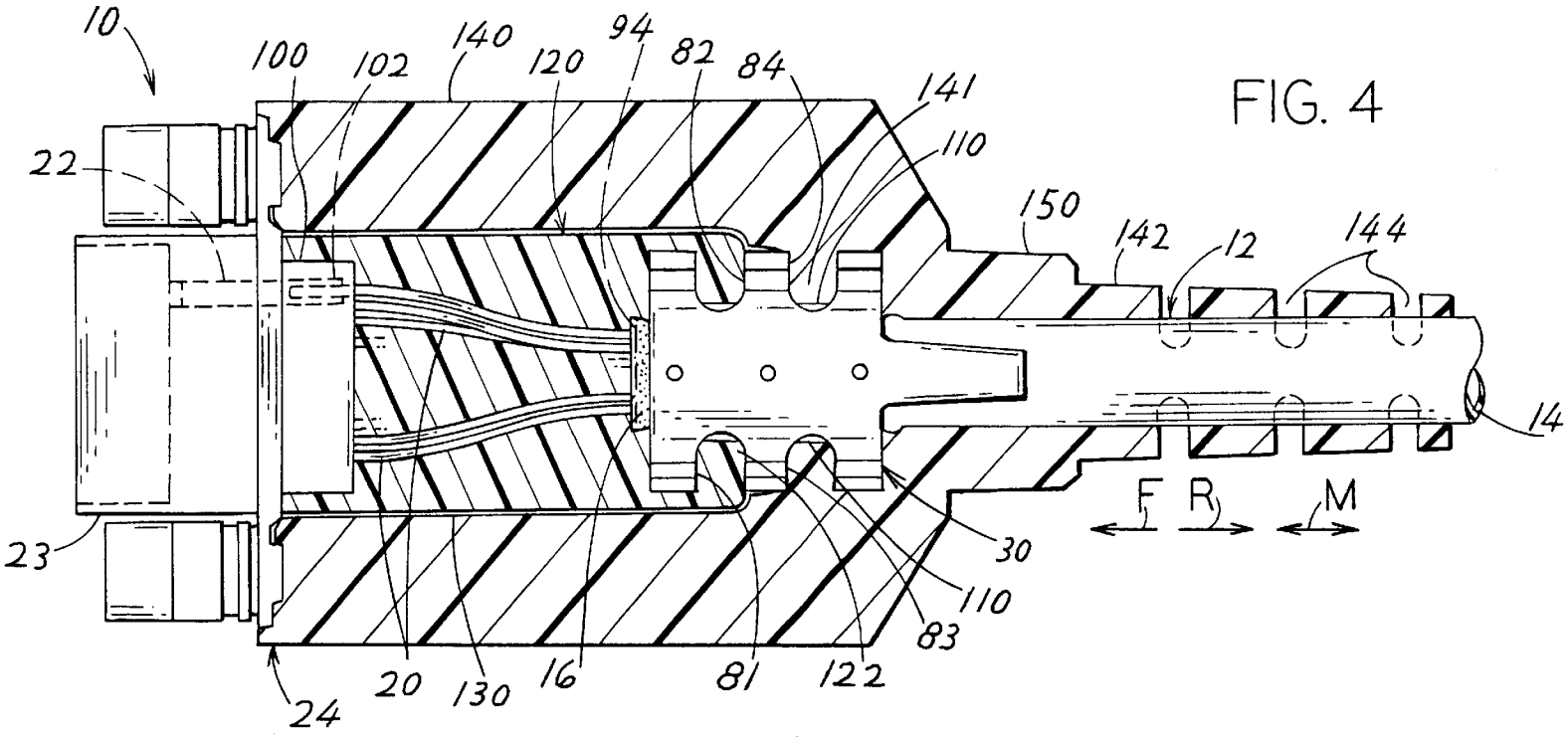
FIG. 4 is a sectional top view of the connector of FIG. 1, showing the clip and other parts of the connector.
Figure 5:
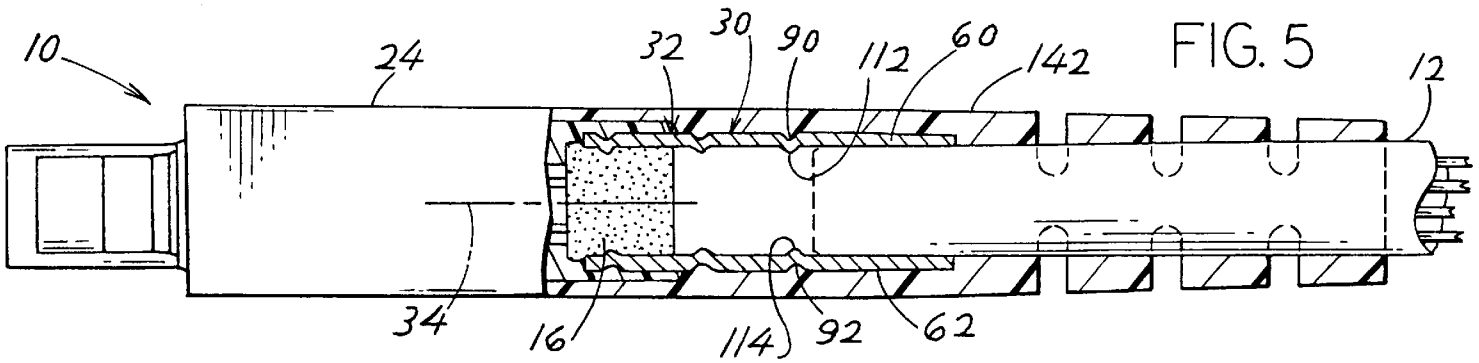
FIG. 5 is a partial sectional view of the connector of FIG. 4.

FIGS. 4 and 5 illustrate the connector 10, with the clip 30 tightly holding the cable 12, and with the clip itself, being tightly held to the frame 24 of the connector. Initially, the jacket 14 and grounding conductor 16 are cut away, and the wires 20 that project from the jacket front end 94 are extended to corresponding contacts 22 in a front insulator portion 100 of the connector. The wires 20 each consist of a copper core and insulation around the core, with the core being terminated to a contact rear end 102 as by soldering. The ground conductor 16, which may be a braiding or metal foil, is wrapped back around the front of the cable jacket as shown in FIG. 5. Then, the clip is crimped to the shape illustrated, to lock the clip to the cable jacket.

Portions of the cable jacket tend to expand as other portions are crimped, and the cable clip allows the jacket to expand into the slots 81–84 of the clip. FIG. 4 shows bulging portions 110 of the crimped cable jacket, which project into the slots 81–84. The wide slots, whose width in the longitudinal direction M is about the same as the distance between the slots, enables considerable bulging of the jacket and receipt of the jacket portions in the slots. The bulging jacket portions help to lock the cable jacket to the clip, while minimizing damage to the jacket. In addition, as shown in FIG. 5, the dimples 90, 92 result in projections 112, 114 that project into the cable jacket to further retain it. The cantilevered beams 60, 62 lie adjacent to the top and bottom of the cable jacket, and help to provide strain relief by providing a large radius of curvature of any bending of the cable immediately behind the sleeve part 62 of the clip. For example, if the connector 10 and the clip 34 are horizontal but the rear end of the cable is pulled down, the lower beam 62 will bend to prevent a sharp bend at the rear of the sleeve 32. It can be seen that the beams 62 extend parallel to each other and to the top and bottom of the sleeve.

After applicant crimps the clip 30 to the cable jacket 14 and connects the wires to the contacts 20, applicant molds a first polymer part 120 of the frame around the wires 20. The first molded polymer part 120 is molded around the front insulator portion 100 (and/or around a shell that encloses the insulator) and is fixed to the clip 30 to prevent the clip from moving with respect to the front insulator portion. Firm attachment to the clip is accomplished by molding the first part 120 so a clip locking portion 122 of the first part extends into slots 81, 82 at the front portion of the clip. The fact that the slots are deep, results in secure fixing of the first molded polymer part 120 to the clip. After the first part 120 is molded, applicant wraps a foil 130 around the first part 120 and around a portion of the clip. The copper foil engages the shell 23 to ground it and surrounds the wires 20, to provide EMI (electromagnetic interference) protection. Then, applicant molds a second polymer part 140 of the frame 24 around the first part 120. The second part 140 preferably has greater elasticity than the first part. The second part has sections 141 that flow into the deep slots 83, 84 at the rear of the sleeve portion of the clip to securely lock to the clip. The second polymer part 140 includes a tubular rear portion 142 that serves as a strain relief. The more rearward region of the tubular portion 142 has multiple grooves 144 that makes it more flexible, while the front portion does not have such grooves to make it stiffer.

As shown in FIGS. 1 and 4, applicant provides laterally thickened regions 150 at laterally opposite sides of the front of the tubular portion 142. The thickened regions each have a lateral thickness at least twice the average lateral thickness of the tubular portion rearward of the thickened regions. They provide higher resistance to sharp sideward bending of the cable at the rear end of the sheet metal clip, although they are not as effective in minimizing sharp bending as the cantilevered beams 60, 62. Applicant can modify the clip to provide cantilevered beams at the rear near the level of the sides to provide better resistance against sharp bending. However, in actual use, most cable bending results from the cable being pulled downwardly.

FIG. 6 shows details of the crimped clip 30. The clip is crimped by a pair of dies 140, 142 that are vertically pressed together to deform the clip into the shape illustrated. The wings such as 61 and 62 each connects one side of the top half-cylinder 144 to one side of the bottom half cylinder 146 of the clip. The dies vertically compress the tube top and bottom toward each other while allowing the sides to laterally expand. However, the expanded sides are vertically compressed so they extend horizontally and are moved substantially together.

In a clip that applicant has designed for a cable having an outside diameter of 5 mm, the uncrimped clip had an outside diameter A of 8.5 mm and was compressed to a height B of 6.6 mm during crimping. The crimping resulted in expansion of the lateral dimension from 8.5 mm to the dimension C of 11.2 mm. Of this width, the largely cylindrical part had a width D of 6 mm, and the wings each had a length E of about 2.6 mm, with each slot such as 83 having the lateral length or depth E of about 2.6 mm. This lateral depth of the slot is a plurality of times the thickness G of 0.89 mm of the material of the clip. The depth E is preferably at least one quarter the diameter of the cable to provide secure holding of the molded first part of the connector frame. Each wing had a height H of 1.91 mm. As shown in FIG. 8, each of the dimples had a height J of 0.25 mm, with dimpled sides extending at 45° to the vertical, to minimize damage to the cable jacket while adding substantial gripping to it. FIG. 9 shows that the overall longitudinal length K of the clip was 17 mm, while the length P of the sleeve part 32 was 10.4 mm and the length Q of each cantilevered beam was 6.6 mm. The longitudinal length S of each slot and of each wing was 2.1 mm.

While terms such as "top", "bottom", etc. have been used to help describe the invention as illustrated, it should be understood that the clip and connector can be used in any orientation with respect to the Earth.

Thus, the invention provides a clip and a connector that includes the clip, where the clip is of simple initial construction and is crimped to a shape that results in secure holding of a cable jacket while providing for secure holding of one or more polymer molded parts to the clip, and while providing increased strain relief. The clip has a sleeve portion that is initially in the form of a hollow cylinder with vertical slots at its opposite sides. The sleeve is vertically crimped in a manner to collapse the portions of the opposite sides that lie between the slots, into wings that form slots of considerable horizontal depth and length. The slots receive the bulging portions of the cable jacket that result from crimping, and receive molded polymer to lock the clip to one or more molded parts of the frame. The crimped clip also preferably has dimples in its top and bottom to provide projections that further help hold the cable jacket. The clip includes a plurality of cantilevered beams extending from the rear end of the sleeve part, to minimize the radius of bending of the cable when the cable is pulled down with considerable force. The connector preferably includes a first molded part that has a clip locking portion that extends into one of the slots, and a second molded part that is molded around the first part and that extends into another one of the slots. The second molded part is preferably of an elastomer material and forms a tubular portion for strain relief, with the cantilevered beams projecting into the tubular portion, and with the tubular portion having thickened regions at the front of its opposite sides to rigidize the tubular portion against sideward bending.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that includes a connector frame with an insulator and a plurality of contacts mounted on said insulator, where said connector is constructed to enable the locking of a cable to the connector frame, comprising:

a clip that includes a sleeve with a longitudinal axis, said sleeve having a top, a bottom, and laterally opposite sides, said sleeve forming a passage along said axis and said cable extending along said axis through said sleeve;

said sleeve having at least a first pair of vertical slots with at least one of said slots lying on each of said opposite sides;

said sleeve is crimped around said cable, by said opposite sides being vertically compressed to form at least two wings at each of said sides where said wings project from said opposite sides with each pair of wings lying on the same one of said sides and with each pair of wings separated by one of said slots;

said cable has a jacket with a front end and said cable has a plurality of wires extending generally forward from said jacket front end and connected to said contacts;

a first polymer molded part that is molded around said wires and around a front end of said clip, with said molded part having clip-locking portions that lie in each of said first slots between two of said wings at each of said sides of said clip;

said sleeve has two second slots with each second slot lying rearward of one of said first slots, and said sleeve forms two third wings lying behind said second slots; and including a polymer overmold that is molded around said first polymer molded part, with said overmold having clip-locking portions that lie in said second slots.

2. A connector comprising:

a connector front part which includes a front insulator portion and a plurality of electrical contacts mounted in said front insulator portion;

a cable having a jacket with a jacket front portion, and a plurality of wire with exposed ends extending forward of said jacket front portion and connected to said contacts;

a clip which lies rearward of said connector front part and that is crimped around said jacket front portion, with said clip having a plurality of slot, and said cable extending in a rearward longitudinal direction from said clip;

a connector frame which includes a first connector frame part which is attached to said clip;

said first connector frame part comprises an integral quantity of polymer that lies around said wire exposed ends and a part of said clip and which extends into said slot;

said connector front part includes a metal shell that surrounds at least part of said front insulator portion; and including a metal foil that extends around said wires and that engages both said clip and said shell.

3. A connector that includes a connector frame with an insulator and a plurality of contacts mounted on said insulator, where said connector is constructed to enable the locking of a cable to the connector frame, comprising:

a clip that includes a sleeve with a longitudinal axis, said sleeve having a top, a bottom, and laterally opposite sides, said sleeve forming a passage along said axis and said cable extending along said axis through said sleeve;

said sleeve having at least a first pair of vertical slots with at least one of said slots lying on each of said opposite sides;

said sleeve is crimped around said cable, by said opposite sides being vertically compressed to form at least two wings at each of said sides where said wings project from said opposite sides with each pair of wings lying on the same one of said sides and with each pair of wings separated by one of said slots;

said cable has a jacket with a front end and said cable has a plurality of wires extending generally forward from said jacket front end and connected to said contacts;

a first polymer molded part that is molded around said wires and around a front end of said clip, with said molded part having clip-locking portions that lie in each of said slots between two of said wings at each of said sides of said clips.

4. A connector, comprising:

a front insulator and a plurality of electrical contacts mounted in said front insulator;

a cable having a cable axis and having a jacket with a jacket front end, said cable having a plurality of wires; extending generally forward of said jacket front end and connected to said contacts;

a clip which lies rearward of said front insulator and that is crimped around said jacket front end, said clip having a longitudinally-extending axis coincident with said cable axis, and said clip having a top, a bottom, and opposite sides;

a connector frame which is attached to said clip and to said connector insulator;

said clip includes top and bottom half-cylinders centered on said clip axis and a plurality of wings that each is integral with and that connects one side of a bottom of said top half-cylinders to one side of a top of said bottom cylinder, with said wings lying at said opposite sides of said clip, and with said plurality of wings including a plurality of longitudinally-spaced wings at each of said clip sides and at least one slot between two wings at each clip side;

said cable jacket bulges into said slots.

5.The connector described in claim 4 including:

said connector frame includes a molded polymer frame part that is molded around a front portion of said clip and that has locking portions that project into said slots.

6. A method for constructing a connector, comprising:

forming a seamless sleeve that has a longitudinally-extending axis, and that has vertically spaced top and bottom sleeve parts and laterally spaced sides, with at least one vertically-extending slot at each of said sides;

inserting a cable that has a cable jacket, through said sleeve;

crimping said sleeve around said cable jacket while allowing said jacket to expand sidewardly into said slots, including vertically compressing said sleeve top and bottom toward each other while said sleeve sides are allowed to expand laterally apart but are compressed vertically to form wings with primarily horizontal top and bottom beams joined by a loop, with the wings at each side lying one forward and the other rearward of the slot at the corresponding side.

7. The method described in claim 6 including:

molding a polymer frame part including allowing the polymer to flow into said slots and harden therein.

8. A connector comprising:

a connector front part which includes a front insulator portion and a plurality of electrical contacts mounted in said front insulator portion;

a cable having a jacket with a jacket front portion, and a plurality of wire with exposed ends extending forward of said jacket front portion and connected to said contacts;

a clip which lies rearward of said connector front part and that is crimped around said jacket front portion, with said cable extending in a rearward longitudinal direction from said clip;

a connector frame which includes a first connector frame part which is attached to said clip;

said clip has a crimped sleeve part which is crimped around said cable, and said clip has a plurality of cantilevered beams extending rearwardly from said sleeve part and lying substantially against said cable to provide strain relief.

9. The connector described in claim 8 wherein:

said cable jacket has a top, a bottom, and opposite sides;

said plurality of beams includes top and bottom beams, lying at said top and bottom of said cable but not at said sides of said cable; and said connector frame has a tubular frame portion that extends around at least rear ends of said beams, with said tubular portion having a front portion that includes thickened regions at opposite sides of said cable jacket.

10. A connector comprising:

a connector front part which includes a front insulator portion and a plurality of electrical contacts mounted in said front insulator portion;

a cable having a jacket with a jacket front portion, and a plurality of wires with exposed ends extending forward of said jacket front portion and connected to said contacts;

a clip which lies rearward of said connector front part and that is crimped around said jacket front portion, with said cable extending in a rearward longitudinal direction from said clip;

a connector frame which includes a first connector frame part which is attached to said clip;

said clip has opposite sides spaced in a lateral direction which is perpendicular to said longitudinal direction, with each of said sides having at least one slot;

said first connector frame part comprises a single molded quantity of polymer that lies around at least part of said frame portion, said wire exposed ends, and a part of said clip, with said quantity of polymer including a locking Portion that projects into said slots.

11. The connector described in claim 10 wherein:

said clip comprises a cylindrical tube with opposite sides forming said slots, but with said cylindrical tube having been vertically compressed with its opposite sides allowed to expand horizontally to form wings, with one of said slots lying longitudinally between two of said wings.

12. The connector described in claim 10 wherein:

said clip is formed of sheet metal and has a top and bottom, with dimples in an outer clip surface threat and corresponding projections at an inner clip surface that project into said cable jacket and with said cable jacket being formed of a polymer and having dimples that received said projections.

* * * * *